US011933533B2

(12) United States Patent
Matsuno et al.

(10) Patent No.: US 11,933,533 B2
(45) Date of Patent: Mar. 19, 2024

(54) BLOWER AND REFRIGERATOR

(71) Applicant: Samsung Electronics Co., Ltd., Suwon-si (KR)

(72) Inventors: Tomohiko Matsuno, Kanagawa (JP); Tomoharu Iwamoto, Kanagawa (JP); Makoto Shibuya, Kanagawa (JP); Tatsuya Seo, Kanagawa (JP); Hitoshi Takase, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 25 days.

(21) Appl. No.: 16/894,704

(22) Filed: Jun. 5, 2020

(65) Prior Publication Data

US 2020/0386468 A1 Dec. 10, 2020

(30) Foreign Application Priority Data

Jun. 7, 2019 (JP) ..... 2019-106738
Apr. 24, 2020 (KR) ..... 10-2020-0050026

(51) Int. Cl.
*F25D 17/06* (2006.01)
*F25D 17/04* (2006.01)

(52) U.S. Cl.
CPC ..... *F25D 17/06* (2013.01); *F25D 17/045* (2013.01); *F25D 2317/063* (2013.01); *F25D 2317/068* (2013.01); *F25D 2400/28* (2013.01)

(58) Field of Classification Search
CPC .. F25D 17/06; F25D 17/045; F25D 2317/063; F25D 2317/068; F25D 2400/28; F25D 2317/0683; F25D 17/062
See application file for complete search history.

(56) References Cited

U.S. PATENT DOCUMENTS 1,816,863 A * 8/1931 Muffly ..... F25B 39/02 62/465
3,126,721 A * 3/1964 Shove ..... F25D 17/045 62/419

(Continued)

FOREIGN PATENT DOCUMENTS

CN 204438646 U 7/2015
JP 1995-127961 A 5/1995

(Continued)

OTHER PUBLICATIONS

Translated_Klm (Year: 2016).*

(Continued)

*Primary Examiner* — Elizabeth J Martin
*Assistant Examiner* — Samba N M N Gaye

(57) ABSTRACT

A blower configured to circulate cold air inside a body of a refrigerator. The blower includes a casing, an impeller accommodated in the casing, and a support member configured to support the impeller against the casing. The impeller includes a disk-shaped base plate rotatably supported by the support member. The casing includes an inner circumferential surface extending so as to gradually move away from an outer circumference of the base plate toward a rotational direction of the impeller at a predetermined position around the outer circumference of the base plate, and a first case flow path between the inner circumferential surface and the outer circumference. An introduction port configured to introduce the cold air to a second case flow path branched from the first case flow path is formed on the inner circumferential surface of the casing.

20 Claims, 6 Drawing Sheets

(56) References Cited

U.S. PATENT DOCUMENTS

| | | | | |
|---|---|---|---|---|
| 2010/0126207 | A1 | 5/2010 | Bae et al. | |
| 2013/0042641 | A1* | 2/2013 | Ryu | F25D 17/065 62/228.1 |
| 2018/0231297 | A1* | 8/2018 | Yoo | F25D 17/067 |
| 2019/0128588 | A1 | 5/2019 | Wang et al. | |

FOREIGN PATENT DOCUMENTS

| | | | | | |
|---|---|---|---|---|---|
| JP | 2018-100808 | A | | 6/2018 | |
| JP | 2018100808 | A | * | 6/2018 | F25D 17/04 |
| KR | 2007072239 | A | * | 7/2007 | |
| KR | 10-0786114 | B1 | | 12/2007 | |
| KR | 10-2008-0041158 | A | | 5/2008 | |
| KR | 20-2009-000907 | U | | 2/2009 | |
| KR | 10-2013-0019307 | A | | 2/2013 | |
| KR | 10-2016-0009533 | A | | 1/2016 | |
| KR | 2016023127 | A | * | 3/2016 | F25D 17/045 |
| KR | 10-2018-0091362 | A | | 8/2018 | |
| WO | 2016199487 | A1 | | 12/2016 | |
| WO | 2018113711 | A1 | | 6/2018 | |

OTHER PUBLICATIONS

Translation of JP2018100808A, Shitara et al., Jun. 28, 2018, Paragraphs 11 and 27. (Year: 2018).*

Translated_Lim (Year: 2007).*

International Search Report of the International Searching Authority in connection with International Application No. PCT/KR2020/007296 dated Sep. 7, 2020, 3 pages.

European Patent Office, "Supplementary European Search Report," dated Jul. 5, 2022, in connection with European Application No. 20818881, 8 pages.

Communication pursuant to Article 94(3) EPC dated Jan. 30, 2024, in connection with European Patent Application No. 20818881.3, 6 pages.

* cited by examiner

BLOWER AND REFRIGERATOR

CROSS-REFERENCE TO RELATED APPLICATIONS

This application is based on and claims priority under 35 U.S.C. 119 to Korean Patent Application No. 10-2020-0050026 filed on Apr. 24, 2020 in the Korean Intellectual Property Office, which claims the benefit of Japanese Patent Application No. 2019-106738 filed on Jun. 7, 2019 in the Japan Patent Office, the disclosures of which are herein incorporated by reference in their entirety.

BACKGROUND

1. Field

The disclosure relates to a blower and a refrigerator.

2. Description of Related Art

In recent, a refrigerator has had a storage compartment subdivided to suit objects to be cooled. The subdivided storage compartment is arranged in a convenient position for the user to use. In addition, in recent years, it has been common to install a ventilation path having a high ventilation resistance and a ventilation path having a low ventilation resistance so as to properly distribute cold air to each storage compartment.

Accordingly, a blower configured to deliver cold air to two ventilation paths is disclosed in patent document 1. The blower includes a casing having a spiral inner circumferential surface, and an impeller rotatably installed in the casing. Particularly, between the inner circumferential surface of the casing and a blowing surface of the impeller, a first case flow path is provided and at the same time, a second case flow path branched from the first case flow path is provided.

The blower disclosed in patent document 1 may blow a large amount of high static pressure air from the first case flow path and at the same time blow a small amount of air from the second case flow path. The blower may supply cold air to a ventilation path having a high ventilation resistance from the first case flow path and may supply cold air to a ventilation path having a low ventilation resistance from the second case flow path. Therefore, the blower may properly distribute the cold air to each storage compartment.

Meanwhile, the impeller is fixed to the casing through a support member. In addition, the support member is fixed to the casing through a fixer protruding outward from a blowing surface of the impeller. Therefore, in this structure, the fixer is installed inside the first case flow path. As a result, the flow of cold air in the first case flow path is obstructed by the fixer, and this causes a situation in which the appropriate amount of cold air is not distributed from the first case flow path to the second case flow path.

SUMMARY

Therefore, it is an aspect of the disclosure to provide a blower configure to distribute an appropriate amount of cold air from a first case flow path to a second case flow path.

Additional aspects of the disclosure will be set forth in part in the description which follows and, in part, will be obvious from the description, or may be learned by practice of the disclosure.

In accordance with an aspect of the disclosure, a blower configured to circulate cold air inside a body of a refrigerator, the blower includes a casing, an impeller accommodated in the casing, and a support member configured to support the impeller against the casing. The impeller includes a disk-shaped base plate rotatably supported by the support member. The casing includes an inner circumferential surface extending so as to gradually move away from an outer circumference of the base plate toward a rotational direction of the impeller at a predetermined position around the outer circumference of the base plate, and a first case flow path between the inner circumferential surface and the outer circumference. An introduction port configured to introduce the cold air to a second case flow path branched from the first case flow path is formed on the inner circumferential surface of the casing. The support member includes a fixer provided to protrude outward than the outer circumference of the base plate and the support member is fixed to the casing through the fixer. An end portion of the fixer, which is positioned on the outermost side with respect to the outer circumference of the base plate, is positioned in a non-distribution region that is other than a distribution region between a first reference line connecting a rotating shaft to a rim on a side opposite to the rotational direction of the introduction port, and a second reference line connecting the rotating shaft to a rim on a side in the rotational direction of the introduction port.

In this case, because the end portion of the fixer, which is positioned on the outermost side with respect to the outer circumference of the base plate, is positioned in the non-distribution region, the fixer may have little effect on the cold air flow in the distribution region that most affects an amount of the cold air distributed from the first case flow path to the second case flow path. Therefore, it is possible to distribute an appropriate amount of cold air from the first case flow path to the second case flow path.

Alternatively, the all fixers may be disposed in the non-distribution region. In this case, the cold air flow in the distribution region may be not disturbed by the fixer. Accordingly, it is possible to distribute more appropriate amount of cold air from the first case flow path to the second case flow path.

In addition, the introduction port as a specific configuration of the blower may be formed in a region between a third reference line connecting the rotating shaft to the predetermined position and a fourth reference line generated by rotating the third reference line toward the rotational direction by 45° with respect to the rotating shaft.

Accordingly, it is possible to discharge the cold air from the first case flow path to the second case flow path without dramatically lowering the air amount and static pressure of the first case flow path.

In addition, as a specific configuration of the blower, a distance between the inner circumferential surface and the blowing surface on the third reference line may be 2 mm or more and 15 mm or less, and an angle between a vertical line of the first reference line and a tangent of the rim of the second case flow path may be greater than 0° and less than 60°.

In accordance with an aspect of the disclosure, a refrigerator includes a blower, a first cold air flow path configured to communicate with a first case flow path of the blower, and a second cold air flow path configured to communicate with a second case flow path of the blower.

In this case, by placing a storage compartment, which is subdivided to suit objects to be cooled, in consideration of the user's convenience, the blower may supply an appropriate amount of cold air, which is appropriate for each ventilation path, even when ventilation paths configured to guide the cold air to the each storage compartment has different ventilation resistance.

The refrigerator may further include a body in which the first cold air flow path and the second cold air flow path are provided. The blower may be removably installed in the body of the refrigerator. The refrigerator may further include a cooling unit configured to cool the cold air to be supplied to an intake port of the blower and the cooling unit may be removably installed in the body of the refrigerator.

Accordingly, the maintenance may be improved because the blower and the cooling unit are removable from the body of the refrigerator.

As for a ratio of an amount of cold air discharged from the first case flow path to the first cold air flow path and an amount of cold air discharged from the second case flow path to the second cold flow path, when the first cold air flow path and the second cold air flow path includes an outlet hole configured to discharge air to the inside of the body, respectively, a discharge amount per unit time discharged from the outlet hole of the second cold air flow path to the inside of the body may be 20% or less of a total discharge amount per unit time discharged from the outlet hole of the first cold air flow path and the second cold air flow path to the inside of the body.

By setting the ratio of the air amount as mentioned above, the amount of the cold air discharged from the first case flow path to the second case flow path may be minimized, and thus the air amount and static pressure of the first case flow path may be increased.

As a specific configuration of the first cold air flow path and the second cold air flow path, the outlet hole of the first cold air flow path and the outlet hole of the second cold air flow path may be arranged in such a way that one thereof is arranged on one side with respect to the rotating shaft, and the other thereof is arranged on a side opposite to the one side with respect to the rotating shaft.

As a more specific configuration, among the outlet holes included in the first cold air flow path, an outlet hole disposed farthest from the rotating shaft may be apart from the rotating shaft 500 mm or more.

In addition, the first cold air flow path may extend upward in the inside of the body.

In this case, it is possible to introduce a large amount of cold air at low temperature from the blower to a position close to an inner wall on the upper surface side inside the body. Therefore, the cold air supplied to the upper portion of the inside of the body may flow downward so as to efficiently cool the inside of the body, thereby saving energy in the refrigerator.

The refrigerator may further include a first storage compartment to which cold air is supplied from the outlet hole of the first cold air flow path, and a second storage compartment to which cold air is supplied from the outlet hole of the second cold air flow path. A volume of the second storage compartment may be less than a volume of the first storage compartment. In this case, among the outlet holes included in the second cold air flow path, an outlet hole disposed farthest from the rotating shaft may be apart from the rotating shaft 500 mm or more.

In this case, the second storage compartment may be used as an ice making compartment having a relatively small volume and the first storage compartment may be used as a freezing compartment having a relatively large volume, and thus it is possible to supply an appropriate amount of cold air for each storage compartment.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter a refrigerator according to the disclosure will be described with reference to the drawings.

A refrigerator according to the disclosure is mainly used in homes. However, the disclosure is not limited to a household refrigerator, and may be applied to a commercial refrigerator. In addition, the refrigerator according to the disclosure includes not only a refrigerator including a refrigerating compartment and a freezing compartment, but also a refrigerator including only a refrigerating compartment, or a refrigerator including only a freezing compartment.

Figure 1:
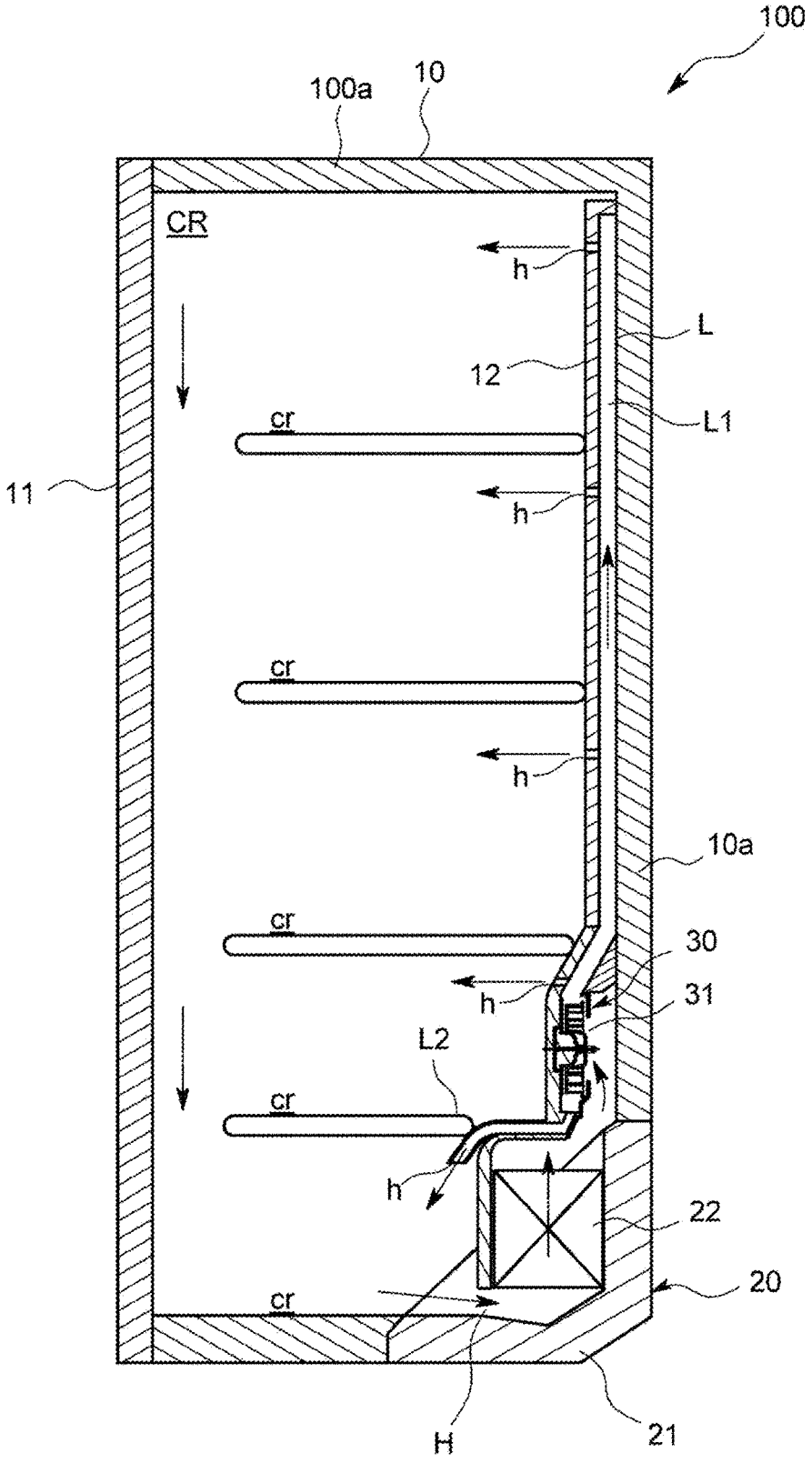
FIG. 1 is a cross-sectional view schematically illustrating an internal structure of the refrigerator according to an embodiment of the disclosure.
Figure 2:
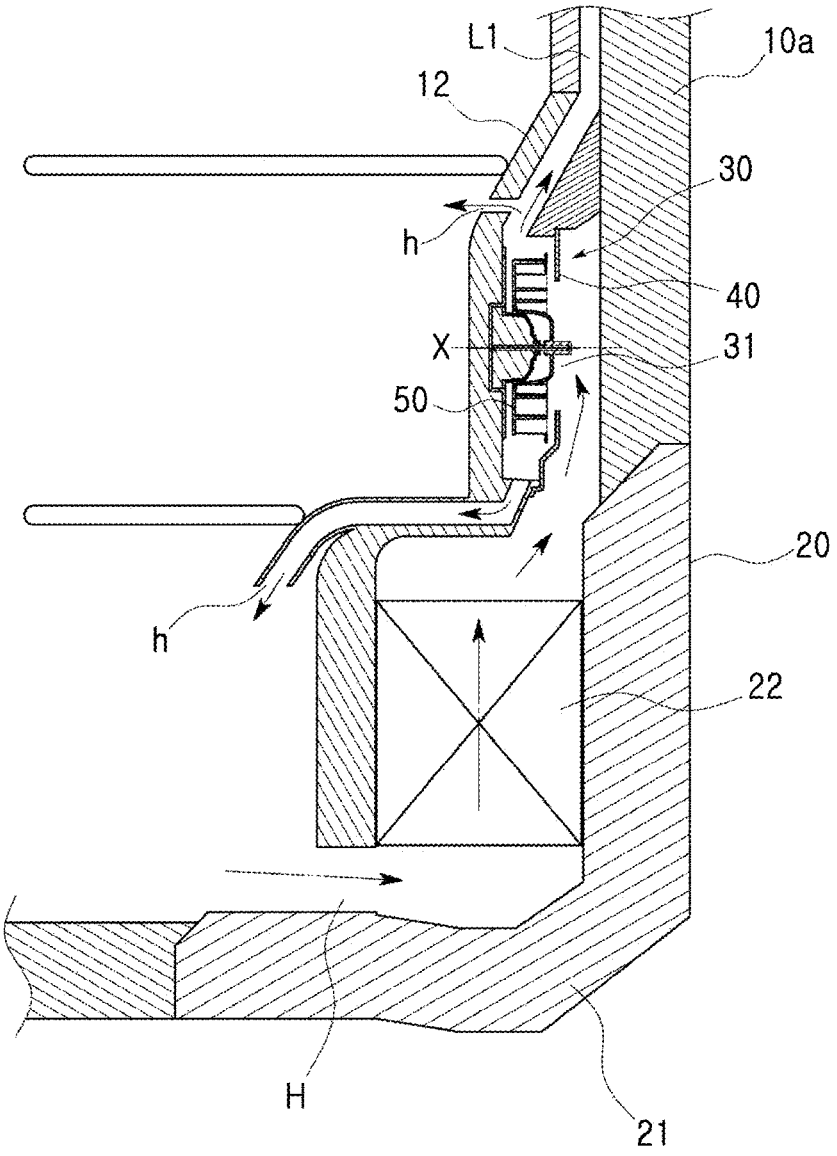
FIG. 2 is an enlarged sectional view schematically illustrating a part of the internal structure of the refrigerator according to an embodiment of the disclosure.

A refrigerator 100 according to an embodiment includes a refrigerator body 10 and a cooling unit 20 connected to the refrigerator body 10, as shown in FIG. 1. The cooling unit 20 according to an embodiment is configured to be removably connected to the refrigerator body 10 from a bottom side (with respect to FIG. 1, a lower side) or a back side (with respect to FIG. 1, a right side).

The cooling unit 20 is configured in such a way that each device constituting a refrigeration cycle device is installed in a unit body 21 forming an outer wall 100*a* of the refrigerator 100 together with the refrigerator body 10. Each of the devices includes a compressor (not shown), a condenser (not shown), and an evaporator 22. In addition, the compressor and the condenser are installed to be disposed on the outside of the body of the refrigerator 100 in a state in which the cooling unit 20 is connected to the refrigerator body 10. On the other hand, the evaporator 22 is installed in the unit body 21 to be disposed inside the body of the refrigerator 100 in a state in which the cooling unit 20 is connected to the refrigerator body 10.

The refrigerator body 10 is formed in a case shape including a door 11 configured to open the case toward the front (with respect to FIG. 1, a left side). The inside of the refrigerator body 10 is divided into a front side (front surface side) and a rear side (rear surface side) by a partition member 12 when viewed from the door 11 side. Accordingly, in the inside of the refrigerator body 10, a cooling room CR is formed in front of the partition member 12, and a circulation path L is formed behind the partition member 12.

The cooling room CR is a space in which food to be cooled is placed. Accordingly, the cooling room CR may be regarded as a storage compartment. Further, the cooling room CR may be divided into a plurality of cooling spaces cr arranged vertically by shelves. In addition, the circulation path L is a passage for cooling and circulating the cold air inside the body. The circulation path L is formed to vertically extend inside the body. Further, the circulation path L is configured to cool the cold air taken from the cooling room CR, and then discharge the cooled air to each cooling space cr of the cooling room CR.

Particularly, the circulation path L is configured to suction cold air from an inlet hole H, which is formed in the partition member 12 to communicate with the lowest cooling space cr, and then discharge the cold air to an outlet hole h, which is formed in the partition member 12 to communicate with each cooling space cr. In the circulation path L, the evaporator 22 of the cooling unit 20 configured to cool the cold air, which is suctioned from the inlet hole H, and a blower 30 configured to blow the cold air are arranged from an upstream side to a downstream side.

In addition, the circulation path L includes a first cold air flow path L1 and a second cold air flow path L2 constituting the downstream side than the blower 30. The first cold air flow path L1 guides the cold air sent from the blower 30 upward than the blower 30 and the first cold air flow path L1 is formed in a duct shape. In addition, the second cold air flow path L2 guides the cold air sent from the blower 30 downward than the blower 30 and the second cold air flow path L2 is formed in a duct shape.

Particularly, the first cold air flow path L1 includes an outlet hole h, which is configured to communicate with a plurality of cooling space cr positioned in the upper portion of the cooling room CR, among the outlet holes h. Therefore, the first cold air flow path L1 is configured to supply cold air, which is sent from the blower 30, to each of the cooling spaces cr located in the upper portion of the inside of the body. The first cooling air flow path L1 according to an embodiment is configured to guide the cold air to other cooling spaces cr except the lowest cooling space cr. Further, among the plurality of outlet holes h included in the first cold air flow path L1, an outlet hole h farthest from the blower 30 is arranged at a position far from a rotation axis X of the impeller 50, which is provided in the blower 30, by 500 mm or more. Particularly, the outlet hole h is set to be placed a position far from the rotation axis X of the impeller 50 by 500 mm or more along the first cold air flow path L1.

In addition, the second cold air flow path L2 includes an outlet hole h, which is configured to communicate with at least one cooling space cr positioned in the lower portion of the cooling room CR, among the outlet holes h. Therefore, the second cold air flow path L2 is configured to supply cold air, which is sent from the blower 30, to the at least cooling spaces cr located in the lower portion of the inside of the body. The second cooling air flow path L2 according to an embodiment is configured to guide the cold air to the lowest cooling spaces cr.

In addition, according to an embodiment, a length of the first cold air flow path L1 is greater than a length of the second cold air flow path L2. In addition, the first cold air flow path L1 is configured to have greater ventilation resistance than that of the second cold air flow path L2. In addition, a total volume of the cooling space cr, to which cold air is supplied from the first cold air flow path L1, is greater than a total volume of the cooling space cr, to which cold air is supplied from the second cold air flow path L2.

The evaporator 22 corresponds to a heat exchanger, and is configured to pass cold air through a plurality of fins. The evaporator 22 is arranged between the inlet hole H of the circulation path L and the blower 30. Accordingly, cold air, which is taken into the circulation path L from the inlet hole H, is cooled while passing through the evaporator 22.

The blower 30 is provided on the partition member 12. Particularly, with respect to the partition member 12, the blower 30 is installed at a distance from the inner wall 10*a* on the rear side of the refrigerator body 10. In addition, the blower 30 includes an intake port 31 on a surface facing the inner wall 10*a*. Therefore, the blower 30 is configured to distribute the cold air sucked from the intake port 31 into the first cold air flow path L1 and the second cold air flow path L2.

All or a part of the partition member 12, particularly, a portion in which the blower 30 is installed, is removable from the refrigerator body 10. Accordingly, the blower 30 may also be attached and removed from the refrigerator body 10 together with a part of the partition member 12. The partition member 12 according to an embodiment has a structure that is divided up and down, and the partition member 12 in the lower side is removable from the refrigerator body 10. The blower 30 is provided on the lower partition member 12.

Figure 3:
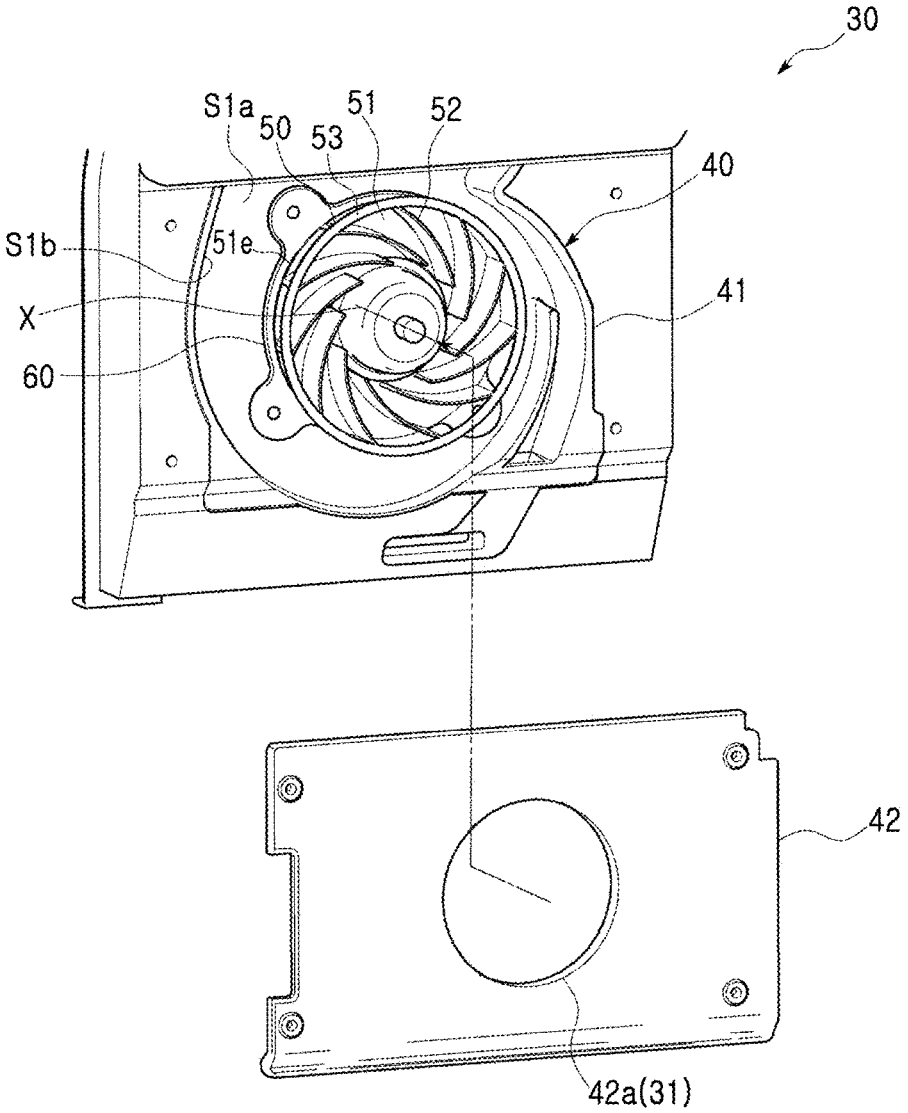
FIG. 3 is a perspective view schematically illustrating a blower of the refrigerator according to an embodiment of the disclosure.
Figure 4:
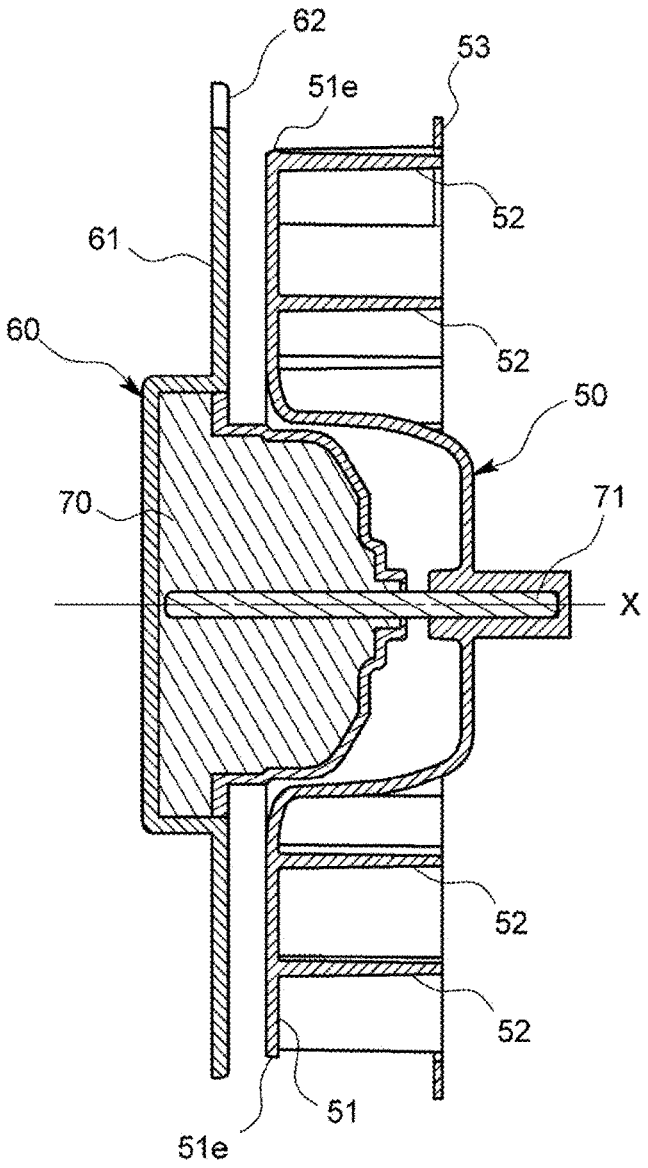
FIG. 4 is a center cross-sectional view schematically illustrating an impeller and a support member of the blower of the refrigerator according to an embodiment of the disclosure.

As illustrated in FIGS. 3 and 4, the blower 30 includes a casing 40 including the intake port 31, the impeller 50 accommodated in the casing 40, and a support member 60 configured to support the impeller 50 against the casing 40.

The casing 40 accommodates the impeller 50. Particularly, the casing 40 incudes a casing body 41 opened in one direction and a cover 42 configured to close the opening of the casing body 41, as shown in FIG. 3. The cover 42 includes a through hole 42*a* forming the intake port 31. The cover 42 according to an embodiment is configured to be fixed to the partition member 12 by means such as screwing.

Further, the casing body 41 is sandwiched between the cover 42 and the partition member 12 and thus the casing body 41 is integral with the partition member 12.

The casing body 41 includes an end surface S1*a* facing the intake port 31 and an inner circumferential surface S1*b* standing on an outer edge (circumference) of the end surface S1*a*. At least a portion of the inner circumferential surface S1*b* of the casing body 41 is formed in a spiral (swirl shape). In addition, the impeller 50 is installed on the end surface S1*a* of the casing body 41 through the support member 60.

The impeller 50 is a centrifugal fan. Particularly, as shown in FIG. 4, the impeller 50 includes a disc-shaped base plate 51 and a plurality of blades 52 protruding from the base plate 51 in the direction of the rotation axis X.

Figure 5:
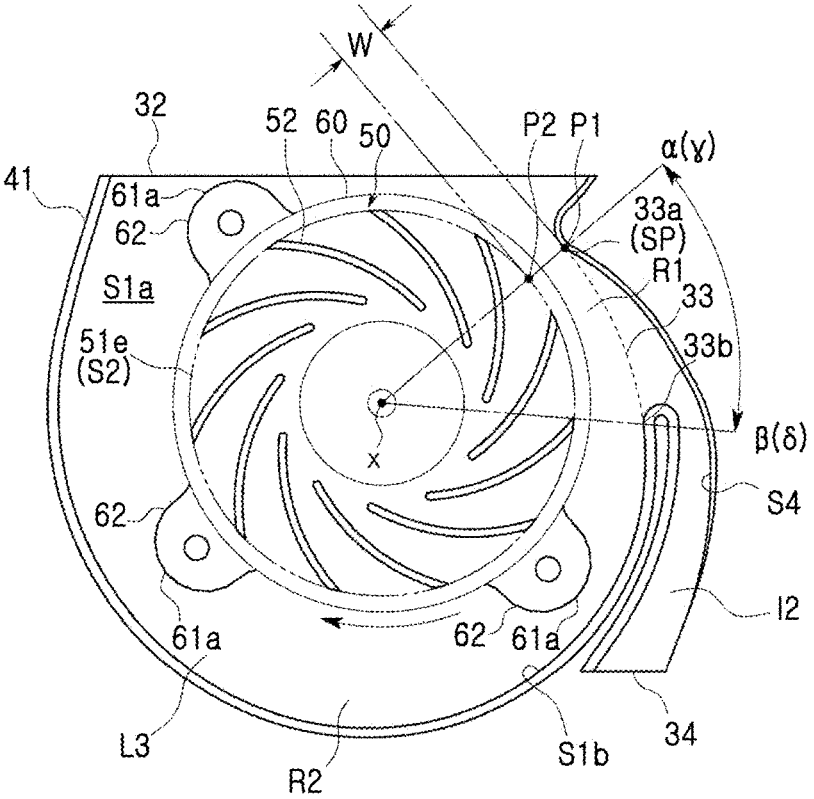
FIG. 5 is a front view schematically illustrating the blower of the refrigerator according to an embodiment of the disclosure.
Figure 6:
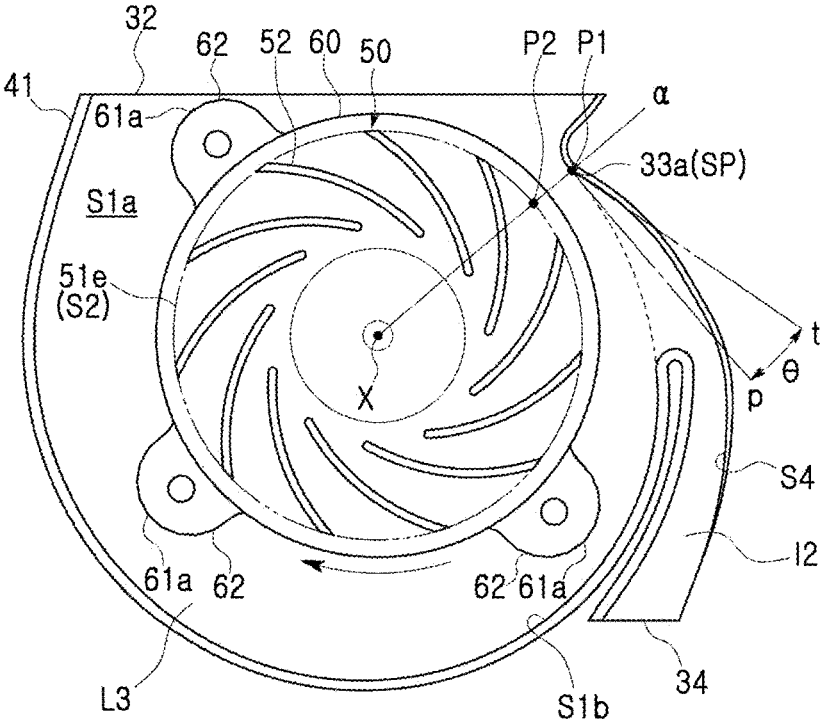
FIG. 6 is a front view schematically illustrating the blower of the refrigerator according to the embodiment of the disclosure.

As illustrated in FIGS. 5 and 6, the plurality of blades 52 is disposed at a distance from each other around the rotation axis X, and extends outwardly (that is, an outside of a diameter direction of the base plate 51) from the rotation axis X. Each blade 52 extends from the rotation axis X to pass an axial line extending in the diameter direction of the base plate 51. Particularly, one end of the blade in a rotational direction with respect to the corresponding the axial line is placed in the rotation axis X side (that is, an inside of the diameter direction of the base plate 51) and the other end of the blade in a direction opposite to the rotational direction with respect to the corresponding the axial line reaches an outer circumference 51*e* of the base plate 51. The impeller 50 includes a blowing surface S2 formed by the outer edge of the plurality of blades 52. The blowing surface S2 has a circular shape when viewed from the rotation axis X direction, and has a concentric circular shape with the outer circumference 51*e* of the base plate 51. In addition, the impeller 50 according to an embodiment includes a reinforcing frame 53 extending along the blowing surface S2, and connected to each blade 52 (refer to FIG. 4).

The support member 60 supports the impeller 50 against the end surface S1*a* of the casing body 41, as shown in FIG. 4. Particularly, the support member 60 includes a support plate 61 configured to support a rotation mechanism 70 such as a motor, and a plurality of fixers 62 protruding from an outer edge of the support plate 61. The support plate 61 according to an embodiment includes a structure to hold the rotation mechanism 70 at the center, and the impeller 50 is fixed to a shaft center 71 protruding from the rotation mechanism 70 and serving as the rotation axis X. In this state, each fixer 62 protrudes more outward than the outer circumference 51*e* of the base plate 51 constituting the impeller 50. In addition, according to an embodiment, a portion of the support member 60 except for the fixer 62 of the support plate 61 is formed in a circular shape having a diameter greater than the base plate 51.

Next, a positional relationship between the casing 40 and the impeller 50 and the support member 60 will be described in detail with reference to FIGS. 5 and 6.

As shown in FIG. 5, the impeller 50 is installed in such a way that, from a predetermined position P1, the outer circumference 51*e* of the base plate 51 faces to gradually move away from a spiral inner circumferential surface S1*b* of the casing body 41 in a rotational direction. That is, at the predetermined position P1, the outer circumference 51*e* of the base plate 51 is installed closest to the inner circumferential surface S1*b*. Therefore, the impeller 50 is installed in such a way that a part of the outer circumference 51*e* of the base plate 51, which is in the rotational direction side and placed in at a position P2 (hereinafter referred to as the closest position P2), which is the closest to the certain position P1 of the inner circumferential surface S1*b*, gradually moves away from the inner circumferential surface S1*b*. Accordingly, in the casing main body 41, a first case flow path L3 which gradually expands toward the rotational direction of the impeller 50 is formed between the inner circumferential surface S1*b* and the outer circumference 51*e*. The inner circumferential surface S1*b* and the blowing surface S2 are set such that a width W between the positions closest to each other (between the predetermined position P1 and the closest position P2) is 2 mm or more and 15 mm or less. In addition, the casing body 41 includes a second case flow path l2 branched from the first case flow path L3.

On the inner circumferential surface S1*b* of the casing body 41, a first discharge port 32 configured to discharge cold air from the first case flow path L3 to the outside of the casing body 41 is formed at a surface at a position opposite to the rotational direction of the impeller 50 at the predetermined position P1, that is, a surface positioned on the downstream of the first case flow path L3. The first case flow path L3 is in a state in communication with the first cold air flow path L1 through the first discharge port 32.

In addition, an introduction port 33 configured to introduce a part of the cold air flowing through the first case flow path L3 into the second case flow path l2 is formed on the inner circumferential surface S1*b* of the casing main body 41. Particularly, on the inner circumferential surface S1*b* of the casing main body 41, the introduction port 33 is formed on a surface positioned on the side in the rotational direction from the predetermined position P1, that is, on the surface positioned on the upstream side of the first case flow path L3.

It is assumed that a line connecting the rotation axis X to a rim 33*a* on a side opposite to the rotational direction of the introduction port 33 is a first reference line α, and a line connecting the rotation axis X to a rim 33*b* on a side in the rotational direction of the introduction port 33 is a second reference line β. Further, it is assumed that a region between the first reference line α and the second reference line β in the first case flow path L3 is a distribution region R1, and a region except for the distribution region R1 is a non-distribution region R2. Therefore, the support member 60 is arranged in such a way that an end portion 61*a* of the fixer 62, which is positioned on the outermost side with respect to the outer circumference 51*e* of the base plate 51, is positioned in the non-distribution region R2.

In addition, as for the fixer 62, when the end portion 61*a* is disposed in the non-distribution region R2, a part of the fixer 62 may be arranged in the distribution region R1. However, it is appropriate that all the end portions 61*a* are arranged in the non-distribution region R2 as in the fixer 62 according to an embodiment.

In addition, it is assumed that a line connecting the rotation axis X to the predetermined position P1 of the inner circumferential surface S1*b* (or the closest position P2 of the blowing surface S2) is a third reference line γ, and a line generated by rotating the third reference line γ toward the rotational direction of the impeller 50 by 45° with respect to the rotation axis X is a fourth reference line S. Therefore, the introduction port 33 is formed in a region between the third reference line γ and the fourth reference line S. The introduction port 33 according to an embodiment is formed in such a way that the first reference line α coincides with the third reference line γ and the second reference line β coincides with the fourth reference line δ.

In addition, the second case flow path l2 extends in a state in which the rim 33*a* of the introduction port 33 on the third reference line γ side functions as a start point SP of the ventilation path (in this embodiment, the same position as the predetermined position P1). The second case flow path l2 extends substantially in parallel with the first case flow path L3. In addition, a second discharge port 34 configured to discharge cold air from the second case flow path l2 is formed on the downstream side of the second case flow path l2. The second case flow path l2 is in a state in communication with the second cold air flow path L2 through the second discharge port 34.

In addition, an inner surface S4 extending from the starting point SP of the second case flow path l2 is set to allow an angle θ formed by a tangent t at the starting point SP and a vertical line p of the first reference line α to be greater than 0° and less than 60°. The angle θ represents an angle generated by spreading the tangent t with respect to the vertical line p outward about the starting point SP.

Next, the flow of cold air flowing through the circulation path L will be described with reference to FIGS. 1, 5, and 6.

First, as illustrated in FIG. 1, the cold air, which flows into the circulation path L from the lowest cooling space cr through the inlet hole H, is cooled while passing through the evaporator 22. Subsequently, the cold air cooled by passing through the evaporator 22 is sucked into the casing body 41 of the blower 30 through the intake port 31. The cold air sucked into the casing body 41 is introduced into the first case flow path L3 by centrifugal force according to the rotation of the impeller 50, and at the same time, a part of the cold air introduced into the first case flow path L3 is introduced into the second case flow path l2. Subsequently, cold air, which is not introduced into the second case flow path l2 but passes through the first case flow path L3, is introduced into the first cold air flow path L1 through the first discharge port 32. In addition, the cold air introduced into the second case flow path l2 is introduced into the second cold air flow path L2 through the second discharge port 34. The cold air introduced into the first cold air flow path L1 is supplied to the cooling space cr above the blower 30 through the outlet hole h. In addition, the cold air introduced into the second cold air flow path L2 is supplied to the cooling space cr below the blower 30 through the outlet hole h.

The cooling room CR according to the above embodiment includes one space divided by shelves, but the cooling room CR may include two spaces. For example, the cooling room CR may be divided into a large-volume refrigerating compartment and a small-volume ice-making compartment. In this case, the blower 30 may be configured to supply cold air discharged from the first case flow path L3 to the large-volume refrigerating compartment, and to supply cold air discharged from the second case flow path l2 to the small volume ice-making compartment. The casing 40 may be formed in such a way that an amount of cold air per unit time supplied to the storage compartment through the second case flow path l2 is 20% or less of an amount of cold air per unit time supplied to the storage compartment through the first case flow path L3 and the second case flow path l2.

In addition, the blower 30 according to the above embodiment is configured to supply cold air to the cooling space cr above the blower 30 through the first case flow path L3, and configured to supply cold air to the cooling space cr below the blower 30 through the second case flow path l2, but is not limited thereto. Therefore, the blower 30 may be configured to supply cold air to the cooling space cr above the blower 30 through both the first case flow path L3 and the second case flow path l2.

In addition, the casing 40 according to the above embodiment is provided with the second case flow path l2 extending to follow the spiral inner circumferential surface S1*b* in the casing body 41, but the second case flow path l2 may not follow the spiral inner circumferential surface S1*b*.

In addition, the introduction port 33 according to the above embodiment may be provided in such a way that the rim 33*a*, through which the first reference line α passes, is positioned on the fourth reference line δ side other than the third reference line γ. In the same manner, the introduction port 33 may be provided in such a way that the rim 33*b*, through which the second reference line β passes, is positioned on the third reference line γ side other than the fourth reference line δ. That is, the introduction port 33 may be formed in a region between the third reference line γ and the fourth reference line δ.

In addition, in the above embodiment, the entire inner circumferential surface S1*b* of the casing body 41 is formed in a spiral shape, but is not limited thereto. For example, a part of the inner circumferential surface S1*b* of the casing main body 41, which is positioned at a side in the rotational direction of the impeller 50 from the predetermined position P1, may be formed in a spiral shape.

In addition, in the above embodiment, the fixer 62 of the support member 60 is fixed in a state of protruding from the end surface S1*a* of the casing body 41. Alternatively, a groove in which the support member 60 is accommodated may be formed on the end surface S1*a* of the casing main body 41, and the support member 60 may be fitted into the groove. In this case, because the fixer 62 is accommodated in the groove, the fixer 62 may not protrude from the end surface S1*a*.

In addition, the blower 30 according to the above embodiment may employ a turbo fan.

As is apparent from the above description, it is possible to distribute an appropriate amount of air from the first case flow path to the second flow path.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a body provided to form a storage compartment;

a partition positioned in the body;

a cooling unit configured to generate cold air; and a blower provided on the partition and configured to blow the cold air generated in the cooling unit to the storage compartment, wherein the blower comprises:

a casing provided to form a first case flow path provided to guide cold air to a portion of the storage compartment and a second case flow path provided to guide cold air to other portions of the storage compartment, the casing comprising an end surface, an inner circumferential surface disposed on an outer edge of the end surface, and a distribution region in which the second case flow path is branched from the first case flow path, wherein the first case flow path extends from a starting portion of the first case flow path adjacent to the distribution region along a rotational direction of an impeller, the second case flow path extends from the distribution region along an outside of the starting portion of the first case flow path, and a portion of the second case flow path is parallel with a portion of the first case flow path and the first case flow path and the second case flow path discharge cold air in opposite directions, wherein the casing includes:

a casing cover fixed to the partition, and a casing body integrally formed with the partition and extending from the partition to the casing cover and the casing body being fixed between the casing cover and the partition, the impeller accommodated on the end surface of the casing, and a support member configured to support the impeller against the casing and comprising multiple fixers fixing the support member to the casing, the multiple fixers arranged on the first case flow path, wherein each of the multiple fixers includes an end portion at an outer side in a radial direction of the impeller, and the end portion for each of the multiple fixers is spaced apart from the distribution region and arranged on the first case flow path inside the casing, and the end portion for each of the multiple fixers is arranged along a downstream region that is downstream from the distribution region on the first case flow path.

2. The refrigerator of claim 1, wherein:

each of the multiple fixers is spaced apart from the distribution region.

3. The refrigerator of claim 1, wherein the casing is positioned closest to an outer circumference of the impeller at a starting point of the first case flow path.

4. The refrigerator of claim 1, wherein the casing is formed in such a way that an area of the first case flow path increases along a direction in which cold air flows.

5. The refrigerator of claim 1, wherein the inner circumferential surface of the casing moves away from an outer circumference of the impeller along a direction in which cold air flows.

6. The refrigerator of claim 1, wherein the casing is formed to allow an amount of cold air guided to the first case flow path to be greater than an amount of cold air guided to the second case flow path.

7. The refrigerator of claim 1, wherein the body comprises a first cold air flow path connected to the first case flow path and a second cold air flow path connected to the second case flow path.

8. The refrigerator of claim 7, wherein a length of the first cold air flow path is greater than a length of the second cold air flow path.

9. The refrigerator of claim 7, wherein:

the first cold air flow path comprises a plurality of outlet holes, and among the plurality of outlet holes, an outlet hole located farthest from the blower is spaced apart from a rotation axis of the impeller by 500 mm or more along the first cold air flow path.

10. The refrigerator of claim 7, wherein the first cold air flow path extends toward an upper portion of the storage compartment.

11. The refrigerator of claim 7, wherein a portion of the storage compartment receiving the cold air from the first cold air flow path has a volume greater than a volume of other portion of the storage compartment receiving the cold air from the second cold air flow path.

12. The refrigerator of claim 7, wherein a flow resistance of the first cold air flow path is greater than a flow resistance of the second cold air flow path.

13. The refrigerator of claim 1, wherein the casing comprises an introduction port provided to guide a portion of the cold air from the first case flow path to the second case flow path.

14. The refrigerator of claim 13, wherein an angle between opposite ends of the introduction port with respect to a rotation axis of the impeller is greater than 0° and less than 45°.

15. The refrigerator of claim 13, wherein the introduction port is located upstream of the first case flow path.

16. The refrigerator of claim 1, wherein an angle between a tangent at a starting point of the second case flow path of the casing and a vertical line perpendicular to a reference line connecting a rotation axis of the impeller to the starting point of the second case flow path is greater than 0° and less than 60°.

17. The refrigerator of claim 1, wherein the cooling unit is removably mounted to the body.

18. The refrigerator of claim 1, wherein each of the multiple fixers protrudes radially outward farther than an outer circumference of the impeller.

19. The refrigerator of claim 1, wherein, in a position where a distance between the inner circumferential surface of the casing and an outer circumference of the impeller is smallest, a distance between the inner circumferential surface of the casing and the outer circumference of the impeller is between 2 mm and 15 mm.

20. The refrigerator of claim 1, wherein the casing is formed in such a way that an amount of cold air per unit time supplied to the storage compartment through the second case flow path is 20% or less of an amount of cold air per unit time supplied to the storage compartment through the first case flow path and the second case flow path.

* * * * *